US006784605B2

(12) United States Patent
Sakai et al.

(10) Patent No.: US 6,784,605 B2
(45) Date of Patent: Aug. 31, 2004

(54) HALOGEN INCANDESCENT LAMP AND A LIGHTING APPARATUS USING THE LAMP

(75) Inventors: Makoto Sakai, Kanagawa-ken (JP); Hideto Mochizuki, Kanagawa-ken (JP); Makoto Bessho, Kanagawa-ken (JP); Kazuhiro Ikejiri, Kanagawa-ken (JP); Masayuki Takahashi, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 130 days.

(21) Appl. No.: 09/819,953

(22) Filed: Mar. 29, 2001

(65) Prior Publication Data

US 2002/0135302 A1 Sep. 26, 2002

(30) Foreign Application Priority Data

Mar. 30, 2000 (JP) ..... 2000-095806
Sep. 20, 2000 (JP) ..... 2000-286218

(51) Int. Cl.[7] ..... H01K 3/00

(52) U.S. Cl. ..... 313/316; 313/579; 313/272; 313/344; 313/569

(58) Field of Search ..... 313/579, 272, 313/316, 569, 344

(56) References Cited

U.S. PATENT DOCUMENTS 4,283,653 A * 8/1981 Brett ..... 313/341
4,316,116 A * 2/1982 Graves et al. ..... 313/344
4,686,412 A * 8/1987 Johnson, Jr. ..... 313/344

* cited by examiner

*Primary Examiner*—Ashok Patel
*Assistant Examiner*—Sharlene Leurig
(74) *Attorney, Agent, or Firm*—Pillsbury Winthrop LLP

(57) ABSTRACT

A halogen incandescent lamp comprises a light-transmitting envelope filled with a gas including a halogen gas and an inert gas. A pair of inner conductive wires is arranged in the envelope. A triple-coiled filament, which has a first coiling, a second coiling, and a third coiling having about 1.5 to about 4 turns, is re-crystallized, is arranged in the envelope, and is connected between ends of the inner conductive wires. The triple-coiled filament is held by a support member. The halogen incandescent lamp may be utilized to a lighting apparatus.

5 Claims, 15 Drawing Sheets

HALOGEN INCANDESCENT LAMP AND A LIGHTING APPARATUS USING THE LAMP

This application bases priority on Japanese applications 2000-095806 filed Mar. 30, 2000 and 2000-286218 filed Sep. 20, 2000. The contents of both of these applications are incorporated herein by reference.

BACKGROUND OF THE INVENTION

1. Field of Invention

The present invention relates to a halogen incandescent lamp using a triple-coiled filament, and a lighting apparatus using the lamp.

2. Description of Related Art

In general, a halogen incandescent lamp utilizes a coiled-coil filament, which is formed into a shorter length than that of a coiled filament. Such a filament, however, is required to be even shorter when it is used in a compact halogen incandescent lamp, for example. In order to shorten the length of a coiled-coil filament, it is known to make a coiled-coiled-coil or a triple-coil filament by winding a coiled-coil filament around a mandrel.

Such a triple-coiled filament can generate radiation close to a point source of visible light. When a lighting apparatus including a reflector is provided with such a halogen incandescent lamp having the triple-coiled filament, it is easy to position the triple-coiled filament around a focus of the reflector. Therefore, visible light generated by the triple-coiled filament is accurately reflected by the reflector. Furthermore, the visible light can accurately irradiate a predetermined area, so that the lighting apparatus has an improved light output ratio. In contrast, the lamp life of such a triple-coiled filament is occasionally short because of sagging and therefore, shorting, during lamp operation.

Japanese Laid Open Utility model Application SHO 58-6369, U.S. Pat. No. 4,499,401 (the '401 patent), and U.S. Pat. No. 4,316,116 (the '116 patent) disclose such a triple-coiled filament for an incandescent lamp. In particular, a triple-coiled filament, described in the '401 patent, has dimensions selected so that it does not require re-crystallization prior to the triple-coiled filament being arranged within the incandescent lamp, simplifying manufacturing. That is, an outer diameter of the triple-coiled filament is in a range of 20*d* to 26*d*, wherein d is a diameter of the tungsten wire. As a result, the triple-coiled filament does not sag during lamp operation, because of its small outer diameter. Therefore, separated windings of the triple-coiled filament do not easily come into contact with each other, avoiding a short circuit. However, when the outer diameter of the triple-coiled filament is in the range of 20*d* to 26*d*, the length of the filament tends to become long because the outer diameter of the filament is shortened. Therefore, it is not easy to apply this filament to a compact halogen incandescent lamp or to position the triple-coiled filament around the focus of the reflector.

Furthermore, the '401 patent explains that the triple-coiled filament of the '116 patent having an outer diameter 27*d*, wherein d is a diameter of a tungsten wire, necessitates a re-crystallization process to eliminate sagging during lamp operation. That is, the grain size of the crystals in the filament grows, so that the re-crystallized triple-coiled filament becomes stronger. However, the elasticity of such a re-crystallized triple-coiled filament decreases excessively, so that it more likely to be damaged by impact. Therefore, when the re-crystallized triple-coiled filament receives an impact from the outside, for example, the re-crystallized triple-coiled filament may vibrate and occasionally break, for example, at the interface of the grains of the crystal.

SUMMARY OF THE INVENTION

According to one aspect of the invention, a halogen incandescent lamp comprises a light-transmitting envelope filled with a gas including a halogen gas and an inert gas. A pair of inner conductive wires are arranged in the envelope. A triple-coiled filament, which has a first coiling, a second coiling, and a third coiling having about 1.5 to about 4 turns, is re-crystallized, arranged in the envelope, and connected between ends of the inner conductive wires. The triple-coiled filament is held by a support member.

According to another aspect of the invention, a lighting apparatus comprises the halogen incandescent lamp described above having a reflector, and a housing accommodating the lamp.

These and other aspects of the invention are further described in the following drawings and detailed description of the invention.

BRIEF DESCRIPTION OF THE DRAWINGS

The invention will be described below in more details by way of examples illustrated by drawings in which.

DETAILED DESCRIPTION OF THE EMBODIMENTS

Figure 1:
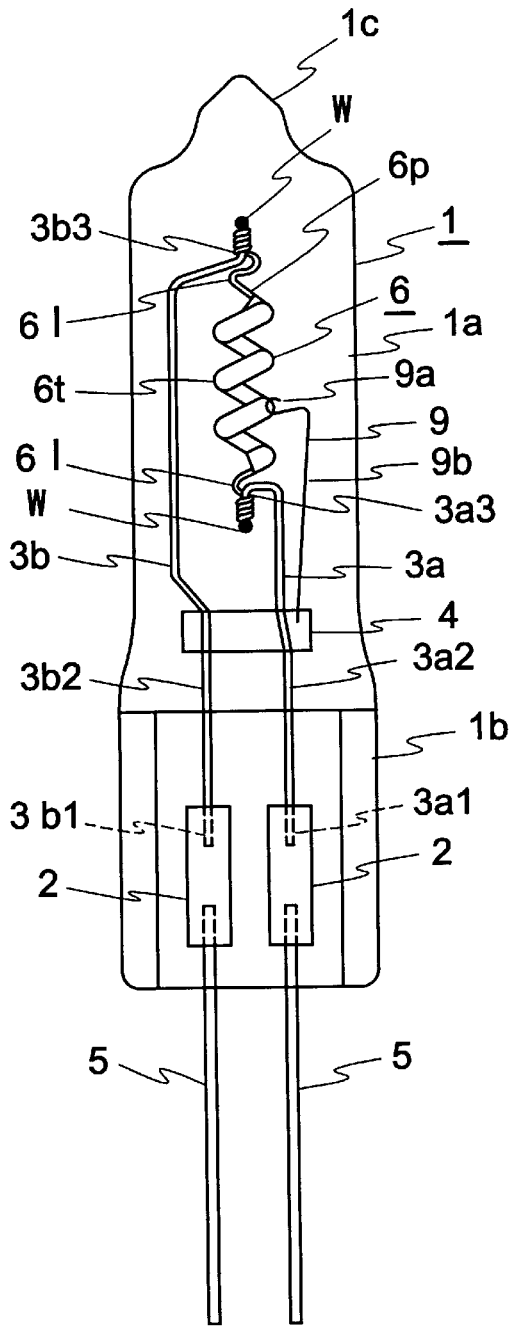
FIG. 1 is a side view of the halogen incandescent lamp according to a first embodiment of the present invention.
Figure 2:
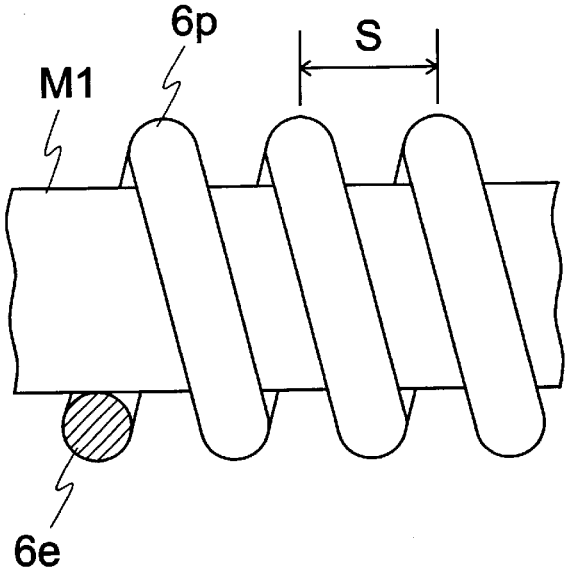
FIGS. 2A and 2B are respectively side and front views of a filament wire, which is wound around a first mandrel to form a coiled filament.
Figure 2:
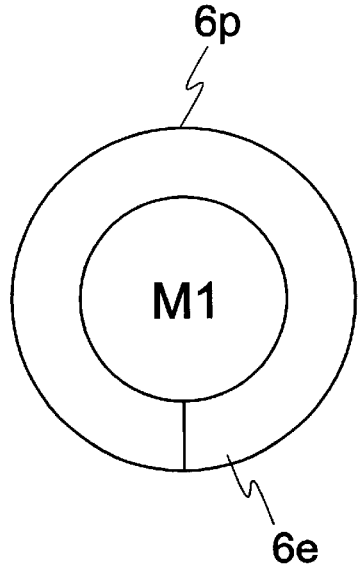
Figure 3:
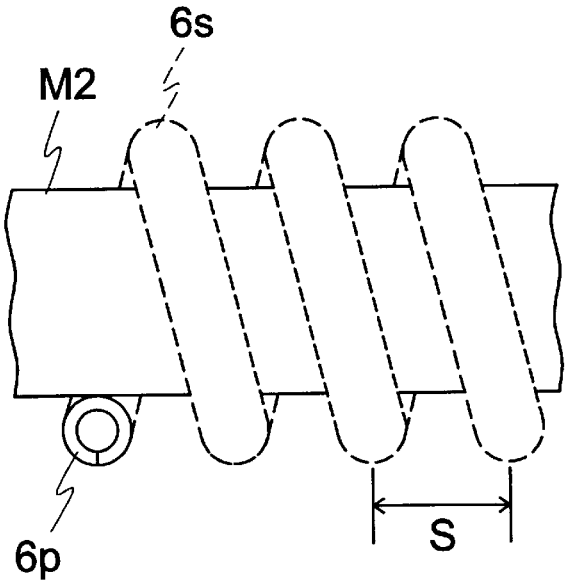
FIGS. 3A and 3B are respectively side and front views of the coiled filament in FIGS. 2A and 2B, which is wound around a second mandrel to form a coiled-coil filament.
Figure 3:
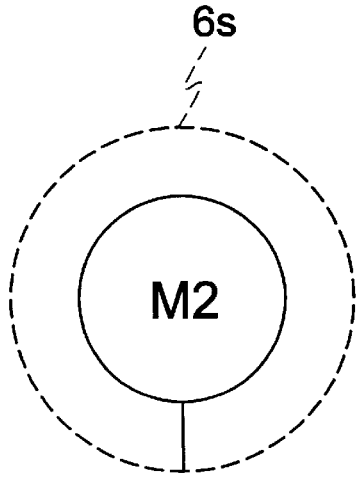
Figure 4:
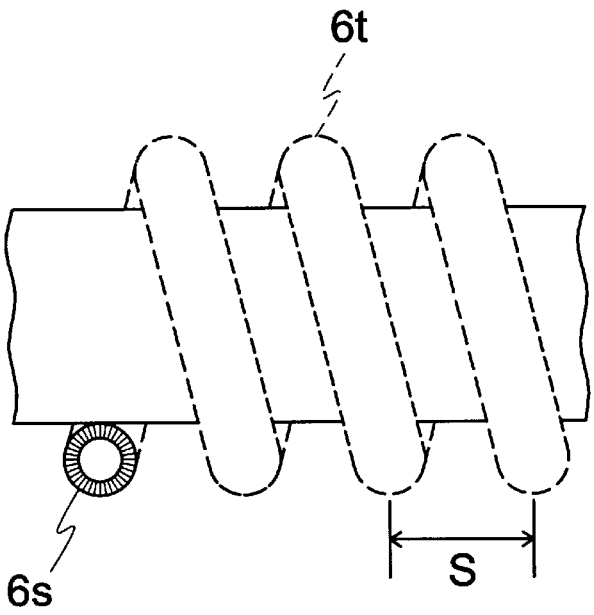
FIGS. 4A and 4B are respectively side and front views of the coiled-coil filament in FIGS. 3A and 3B, which is wound around a third mandrel to form a triple-coiled filament.
Figure 4:
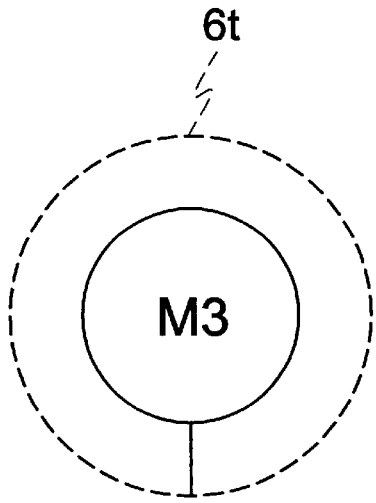
Figure 5:
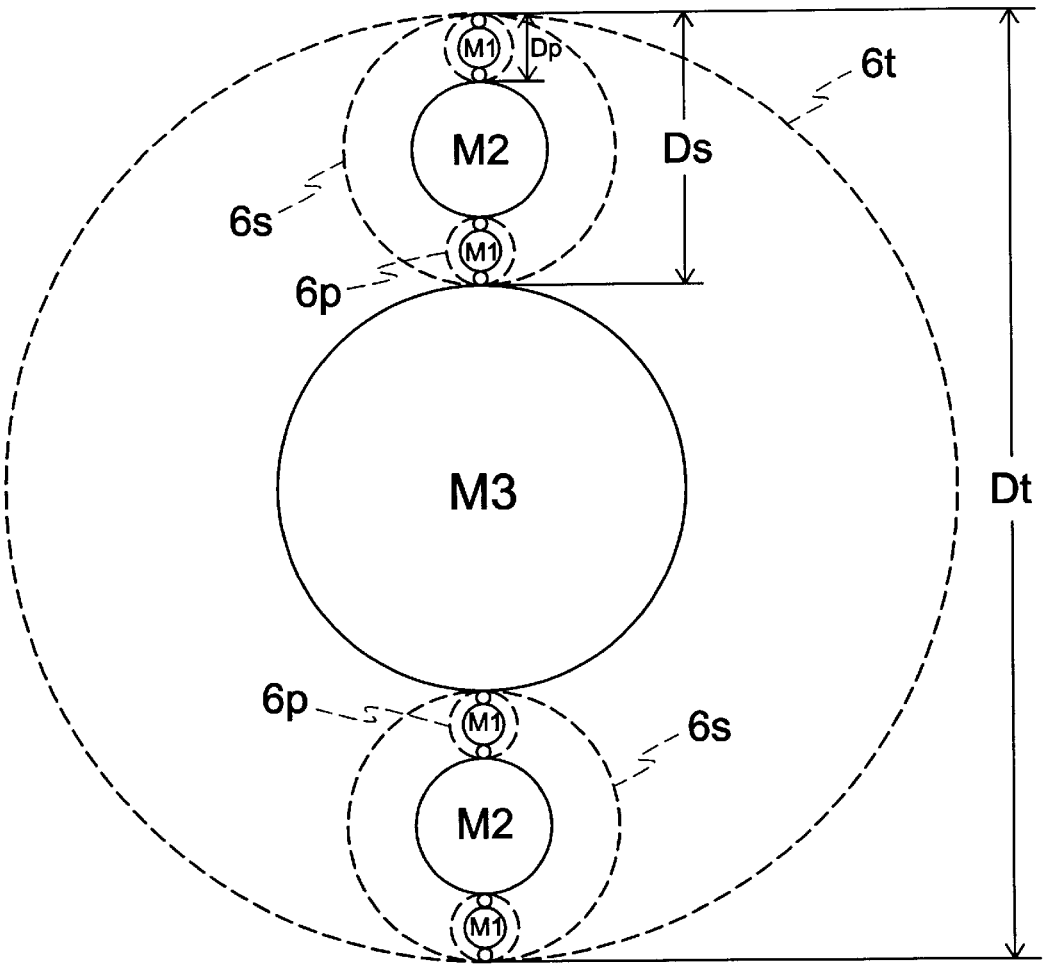
FIG. 5 shows a schematic relationship of both the mandrels and the triple-coiled filament shown in FIGS. 2A to 4B.

A first embodiment of the invention will be described below in detail with reference to FIGS. 1 to 5. A halogen incandescent lamp shown in FIG. 1 comprises a hermetically sealed light-transmitting envelope 1 made of quartz glass. A pair of inner conductive wires 3*a*, 3*b* made of tungsten are arranged in the envelope 1. A triple-coiled filament 6 made of tungsten filament wire 6*e*, which has a first coiling 6*p*, a second coiling 6*s*, and a third coiling 6*t*, is disposed in the envelope 1 along the center axis of the envelope 1. Each of legs 6*l*, 6*l*, which is made of the first coiling 6*p*, extending from each end of the triple-coiled filament 6, is connected between the inner conductive wires 3*a*, 3*b*. When the legs 6*l* of the triple-coiled filament 6 are formed by either the filament wire 6*e*, the first coiling 6*p*, or the second coiling 6*s*, the legs 6*l* are not easily illuminated because they are not heated. Accordingly, the filament 6 can generate a greater total luminous flux. The first coiling 6*p* may extend beyond the second coiling 6*s*, and the second coiling 6*s* may extend beyond the third coiling 6*t*. It is suitable for the first coiling 6*p* to extend directly from the third coiling 6*t*.

A glass bead 4 fixes the inner conductive wires 3*a*, 3*b* at intermediate portions 3*a*2, 3*b*2 of the inner conductive wires. Each of molybdenum foils 2, 2, embedded in a sealed portion 1*b* of the envelope 1, is welded to the inner conductive wires 3*a*, 3*b*, and is also connected to the conductive wires 5, 5.

The light-transmitting envelope 1 is continuously formed with a cylindrical portion 1*a*, the sealed portion 1*b* at one end of the cylindrical portion 1*a*, and an exhaust tube portion 1*c* at the other end of the cylindrical portion 1*a*. Furthermore, the envelope 1 is filled with a filling gas comprising a halogen gas, e.g., bromide (Br), a rare gas, e.g., krypton (Kr) and an inert gas, e.g., nitrogen (N2), the inert gas having a partial pressure of 40% of the total pressure. The halogen gas may be a simple substance, which is one or more substances selected from chlorine (Cl), bromide (Br) or iodide (J), or an organic halogen compound. The rare gas may be argon (Ar) or xenon (Xe).

Figure 8:
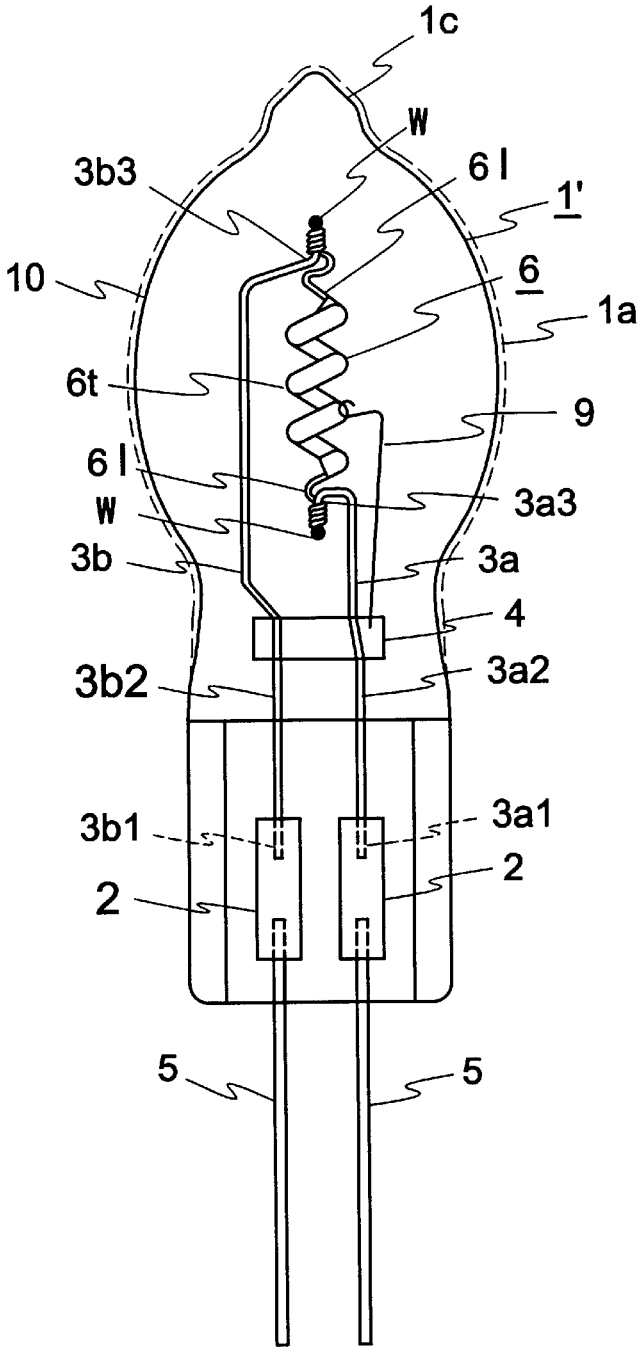
FIG. 8 is a side view of a halogen incandescent lamp according to a fourth embodiment.
Figure 15:
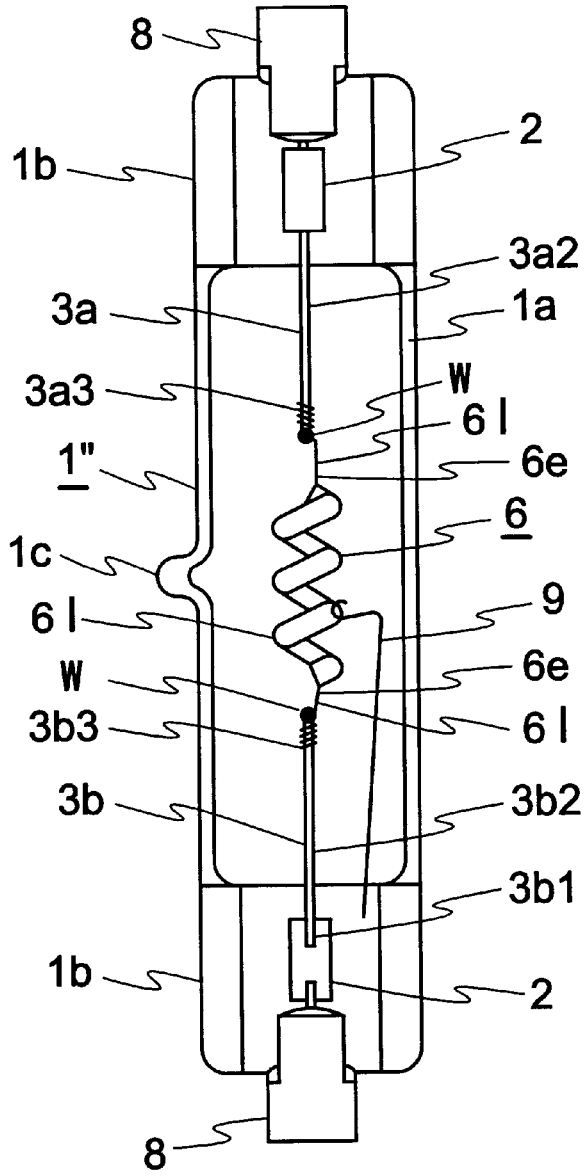
FIG. 15 is a side view of a halogen incandescent lamp according to a ninth embodiment of the present invention.

The cylindrical portion la may be formed into a spherical shape or an ellipsoid shape as shown in FIG. 8. The sealed portion 1*b* may be formed at both ends of the cylindrical portion 1*a* as shown in FIG. 15. The surface of the light-transmitting envelope may be coated with an interference filter to improve the luminous efficacy of the lamp. The interference filter, which is made of alternating layers of a low refractive index material and a high refractive index material, can reflect infrared radiation from a triple-coiled filament back to the filament and transmit visible light from the filament through the envelope. Furthermore, since the total surface area of the triple-coiled filament is relatively large, the filament can effectively capture the infrared radiation reflected by the filter. Accordingly, the temperature of the filament is increased, so that the filament generates more visible light. The low refractive index layer may be made of metal oxide, e.g., silicon oxide (SiO2) or magnesium fluoride (MgF2). The high refractive index layer may be made of metal oxide, e.g., titanium oxide (TiO2), tantalum oxide (Ta2O5), zirconium oxide (ZrO2) or zinc sulfide (ZnS). The interference filter may be coated on at least the cylindrical portion 1*a* of the envelope 1.

Each of the inner conductive wires 3*a*, 3*b*, arranged in the envelope 1 in parallel, is welded with one of the molybdenum foils 2, 2 embedded in the seal portion 1*b*. One end of the inner conductive wire 3*a* is formed into a U-shape as a connecting portion 3*a*3, and is connected to the leg 6*l* of the triple-coiled filament 6 at the sealed portion 1*b* side. The connecting portion 3*a*3 is located on the center axis of the envelope 1. The other end 3*a*1 of the inner conductive wire 3*a* is connected to the molybdenum foil 2. One end of the inner conductive wire 3*b* is formed into a connecting portion 3*b*3, and is connected to the leg 6*l* of the triple-coiled filament 6 adjacent to the exhaust tube portion 1*c*. The other end 3*b*1 of the inner conductive wire 3*b* is connected to the molybdenum foil 2. The connecting portions 3*a*3, 3*b*3 and the legs 6*l*, 6*l* of the filament are respectively welded at welding portions w in order to be strongly joined.

The outer conductive wires 5, 5 made of tungsten extend outwardly from the sealed portion 1*b* of the envelope 1.

The triple-coiled filament 6 used in the halogen incandescent lamp will be now described. The first coiling 6*p* made of a refractory metal filament wire 6*e*, has an outer diameter Dp (shown in FIG. 5), and is wound around a first mandrel M1. The filament wire 6*e* made of a single strand tungsten wire, has a diameter in the range of about 0.036 mm (about 4 MG) to about 0.1 mm (about 30 MG). The above unit of "MG" means a weight (mg) of 200 mm of the refractory metal filament wire 6*e*. The second coiling 6*s*, having an outer diameter Ds (shown in FIG. 5), is formed by winding the first coiling 6*p* around a second mandrel M2. The third coiling 6*t* having an outer diameter Dt (shown in FIG. 5) is formed by winding the second coiling 6*s* around a third mandrel M3 three and half turns.

Furthermore, the triple-coiled filament 6 is re-crystallized by annealing the triple-coiling filament at a re-crystallization temperature. Furthermore, the triple-coiled filament is formed so that the third coiling has about 1.5 to about 4 turns, and furthermore is held by a support member 9.

The support member 9 holds the third coiling 6*t* portion by a ring-shaped portion 9*a*. The other end 9*b* of the support member 9 is fixed by the glass bead 4. The support member 9, made of molybdenum or tungsten, can support the filament 6 in order to reduce the adverse affects of vibration and impact. An inner diameter of the ring-shaped portion 9*a* may be two or more larger than the outer diameter Dt of the triple-coiled filament 6. The ring-shaped portion 9*a* may not touch the filament 6 so as not to reduce the luminous efficacy of the filament 6. The support member 9 improves the impact characteristics of the triple-coiled filament 6, so that the filament 6 is not easy deformed or broken by an external force.

Furthermore, when the lamp has a reflector, the triple-coiled filament is proximate to the focus of the reflector. Therefore, visible light generated by the filament can be accurately reflected, and the visible light can accurately irradiate a predetermined area, so that light output ratio of the lighting apparatus can be efficiently improved.

The re-crystallized filament may be controlled so as to have an extension ratio, defined below, of about 600% or more. Each of the legs may also be re-crystallized. As a result, the re-crystallized triple-coiled filament can have sufficient elasticity and the impact characteristics. The extension ratio of the triple-coiled filament is measured according to a tensile test: First, the ends of the filament are pulled in opposite directions. Next, an extended length of the filament is measured, at the time that the filament is broken. Finally, an extension ratio is calculated by dividing the extended length of the filament by its original length.

The triple-coiled filament 6, arranged in the envelope 6, may have an outer diameter Dt of about 2 mm to about 4 mm, and have a length of about 3 mm to about 10 mm. The upper limit of the length may be about 7 mm. The length of each of the legs may be in the range of about 0.5 mm to about 2 mm. A ratio A/B (%) of the length of the leg (A) to the length of the filament (B) may be about 7% to about 50%. The first mandrel M1 may have a diameter DM1 of about 0.1 mm to about 1.5 mm. The second mandrel M2 may have a diameter DM2 of about 0.5 mm to about 5 mm.

Furthermore, the triple-coiled filament 6 has a pitch p1 of the first coiling 6*p*, a pitch p2 of the second coiling 6*s*, and a pitch p3 of the third coiling 6*t*. Each of the pitches is a distance S from center to center of two adjacent coils of the first coiling 6*p*, the second coiling 6*s*, or the third coiling 6*t*, respectively. Generally, the first coiling 6*p*, the second coiling 6*s*, and third coiling 6*t* have respectively a pitch ratio (% pitch) of % p1, % p2, and % p3. The % pitch is defined as follows: % pitch=(S/D)* 100. In the case of the first coiling 6*p*, D is the filament wire 6*e* diameter d and S is the pitch p1. For the second coiling 6*s*, D is an outer diameter Dp of the first coiling 6*p* or 2*d+DM1 and S is the pitch p2. For the third coiling 6*t*, D is an outer diameter Ds of the second coil 6*s* or 4*d+2*DM1+DM2 and S is the pitch p3.

In this embodiment, the pitches p1, p2, and p3 are related as follows: p1≧p2≧p3. In general, a hot spot, which is a more heated portion of a filament, tends to occur during lamp operation because of the radiant and conductive heat generated by the filament. The radiant and conductive heat tends to be greater at the first coiling 6*p*or the second coiling 6*s*, because both coils are surrounded by the third coiling 6*t*. In particular, since the first coiling 6*p* is surrounded by the second coiling 6*s* and the third coiling 6*t*, the heat of the filament 6 is more likely to be kept about the first coiling 6*p*. When a hot spot occurs, the filament 6 evaporates more rapidly. Accordingly, the filament 6 of the lamp may occasionally break because of a hot spot.

Therefore, the pitch p1 of the first coiling 6*p* may be larger than the pitch p2 of second coiling 6*s* and the pitch p3 of the third coiling 6*t*, so that the heat conduction from the second and third coilings to the first coiling 6*p* tends to decrease slightly. Therefore, hot spots tend not to occur as frequently. Furthermore, when each pitch % p1, % p2, and % p3 is less than 130%, hot spots are likely to occur because the distance between the coils is shortenly. When each of % p1, % p2, and % p3 is too large, the filament cannot have satisfactory elasticity and impact characteristics. Accordingly, % p1, % p2, and % p3 may be as follows: about 130≦% p1≦about 400, about 130≦% p2≦about 300, and about 130≦% p3≦about 300. In this case, a CL/EL ratio may be provided as follows: about 1/100≦CL/EL≦about 1/55, wherein the CL indicates a length of the triple-coiled filament, the EL indicates a whole length of the filament wire 6*e*. When the CL/EL ratio is less than about 1/100, the pitches of the filament and the diameters of the mandrels tend to be small, so that hot spots can occur which weaken the filament. However, when the CL/EL ratio is more than about 1/55, the filament lengthens excessively. For example, a 60 W-lamp supplied with about 110 V has a CL/EL of about 1/70. A 40 W-lamp has a CL/EL ratio of about 1/94. The triple-coiled filament did not break during impact testing, even when it was dropped over 300 times from a height of about 1 mm.

When the lamp is used in a lighting apparatus, even if the lamp generates a total luminous flux of about 60%, which corresponds to a maximum flux of the conventional lamp having a coiled-coil filament, visible light generated by the lamp can be more accurately reflected and irradiate a predetermined area as compared with a lighting apparatus using the conventional lamp, so that the light output ratio of the lighting apparatus can be improved.

% p1, % p2, and % p3 of the filament may be as follows: about 150≦% p1≦about 250, about 150≦% p2≦about 250, and about 150≦% p3≦about 250. The triple-coiled filament did not break during impact testing, even when it was dropped over 300 times from a height of about 1.5 mm.

% p1, % p2, and % p3 may be as follows: about 160≦% p1≦about 250, about 160≦% p2≦about 250, and about 150≦% p3≦about 200. The triple-coiled filament did not break during impact testing, even when it was dropped over 300 times from a height of about 2 mm.

Furthermore, generally, the first coiling 6*p*, the second coiling 6*s*, and the third coiling 6*t* have respectively a mandrel ratio (hereunder %mandrel) of %M1, %M2, and %M3. The %mandrel is defined as follows: %mandrel=(DM/D)* 100. In case of the first coiling 6*p*, D is the filament wire 6*e* diameter d and DM is the diameter DM1 of the first mandrel. For the seconding coil 6*s*, D is an outer diameter Dp of the first coiling 6*p*or 2* d+DM1 and DM indicates the diameter DM2 of the second mandrel M2. For the third coiling 6*t*, D is an outer diameter Ds of the second coiling 6*s* or 4* d+2* DM1+DM2 and DM is the diameter DM3 of the third mandrel M3.

In this embodiment, DM1, DM2, and DM3 may be related as follows: DM1<DM2<DM3. %M1, %M2, and %M3 may be as follows: about 100≦%M1≦about 700, about 100≦%M2≦about 300, and about 100≦%M3≦about 700. When each of %M1, %M2, and %M3 is less than 100%, hot spots may occur, because the inner diameter of each coil becomes small relative to an outer diameter thereof. Therefore, spaces within the filament are reduced, so that the heat tends to be kept in the filament. If each of %M1, %M2, and %M3 is too large, the filament is more subjected to vibration and impact damage. The triple-coiled filament did not break in impact testing, even when it was dropped over 300 times from a height of about 1 mm. In this case, in order to further reduce hot spots, a DM2/DM1 ratio and DM3/DM1 ratio may be as follows: about 1.5≦DM2/DM1≦about 2.5, and about 6≦DM3/DM1≦about 25.

Furthermore, when the triple-coiled filament is formed so that 100≦%M1≦about 700, about 100≦%M2≦about 300, and about 100≦%M3≦about 700, %M1, %M2, and %M3 may be as follows: %M1≧%M3≧%M2. Accordingly, the filament can further improve its vibration and impact resistance properties.

Furthermore, %M1, %M2, and %M3 may be as follows: about 150≦%M1≦about 600, about 150≦%M2≦about 250, and about 150≦%M3≦about 600. In this case, hot spots can be further avoided. The triple-coiled filament did not break in impact testing, even when it was dropped over 300 times from a height of about 1.5 mm.

Furthermore, %M1, %M2, and %M3 may be as follows: about 150≦%M1≦about 400, about 150≦%M2≦about 200, and about 150≦%M3≦about 400.

Furthermore, in order to improve vibration and impact resistance characteristics, %M1, %M2, and %M3 may be as follows: about 100≦%M1≦about 600, about 100≦%M2≦about 200, and about 100≦%M3≦about 200. The numbers of turns of each of the first coiling 6*p*, the second coiling 6*s*, and the third coiling 6*t* may be decreased as compared to the previously mentioned coilings.

When the first coiling 6*p*, the second coiling 6*s*, and the third coiling 6*t* are all wound in the same direction, an inner stress within the filament 6 occurs so that the filament lengthens. In order to remove the inner stress, either the first coiling 6*t*, the second coiling 6*s*, or the third coiling 6*t* may wind in the opposite direction. Accordingly, the inner stress within the filament 6 can be reduced, so that the filament 6 does not easily deform during lamp operation.

Examples 1 to 4 of a triple-coiled filament will be described below in detail. When the filament is applied to a halogen incandescent lamp, the length of the filament and the diameter of the third coiling may change from the original design of the filament, because the filament is usually arranged between the conductive wires 3*a*, 3*b*, while it is tensioned or extended. Therefore, the length of the filament arranged between the conductive wires may be longer than that of the original design length. The outer diameter of the third coiling may be smaller than that of the original design diameter.

EXAMPLE 1

A triple-coiled filament in this Example 1 is applied to a lamp having a rated voltage of 110V, and a rated lamp wattage of 60 W.

| | First coiling | Second coiling | Third coiling |
|---|---|---|---|
| Diameter (mm) | 0.052 | 0.255 | 0.809 |
| Diameter of mandrel (mm) | 0.15 | 0.30 | 1.20 |
| % mandrel | 287 | 118 | 148 |
| % pitch | 221 | 193 | 179 |
| Original design length of filament (mm) | | | 5.2 |
| Original design outer diameter (mm) | | | 2.82 |
| Turns of third coiling | | | 3.9 |

EXAMPLE 2

A triple-coiled filament in this Example 2 is applied to a lamp having a rated voltage of 110V, and a rated lamp wattage of 40 W.

| | First coiling | Second coiling | Third coiling |
|---|---|---|---|
| Diameter (mm) | 0.042 | 0.233 | 0.767 |
| Diameter of mandrel (mm) | 0.15 | 0.30 | 1.00 |
| % mandrel | 360 | 129 | 130 |
| % pitch | 230 | 197 | 153 |
| Original design length of filament (mm) | | | 4.3 |
| Original design outer diameter (mm) | | | 2.53 |
| Turns of third coiling | | | 3.6 |

EXAMPLE 3

A triple-coiled filament in this Example 3 is applied to a lamp having a rated voltage of 240V, and a rated lamp wattage of 60 W.

| | First coiling | Second coiling | Third coiling |
|---|---|---|---|
| Diameter (mm) | 0.031 | 0.212 | 0.724 |
| Diameter of mandrel (mm) | 0.15 | 0.30 | 1.00 |
| % mandrel | 484 | 141 | 166 |
| % pitch | 220 | 188 | 172 |
| Original design length of filament (mm) | | | 4.4 |

-continued

| | First coiling | Second coiling | Third coiling |
|---|---|---|---|
| Original design outer diameter (mm) | | | 2.65 |
| Turns of third coiling | | | 3.5 |

EXAMPLE 4

A triple-coiled filament in this Example 4 is applied to a lamp having a rated voltage of 240V, and a rated lamp wattage of 40 W.

| | First coiling | Second coiling | Third coiling |
|---|---|---|---|
| Diameter (mm) | 0.024 | 0.198 | 0.696 |
| Diameter of mandrel (mm) | 0.15 | 0.30 | 1.30 |
| % mandrel | 625 | 152 | 187 |
| % pitch | 256 | 220 | 178 |
| Original design length of filament (mm) | | | 4.1 |
| Original design outer diameter (mm) | | | 2.69 |
| Turns of third coiling | | | 3.3 |

In this embodiment, the halogen incandescent lamp has a rated lamp wattage in the range of about 40 W to about 100 W, and is supplied with a voltage of about 100V to about 240V. The halogen incandescent lamp can achieve a lamp life of 3000 hours, a total luminous flux of about 700 lm to about 1300 lm, and a color temperature in the range of about 2600 to about 3300 Kelvin. For example, the 40 W-lamp has similar characteristics to those of a conventional 60 W-lamp having a coiled-coil filament. The 60 W-lamp has similar characteristics to those of a conventional 100 W-lamp having a coiled-coil filament. Accordingly, the wattage of the lamp of this embodiment can be reduced in the range of about 30% to about 40% as compared to the conventional lamp.

Figure 6:
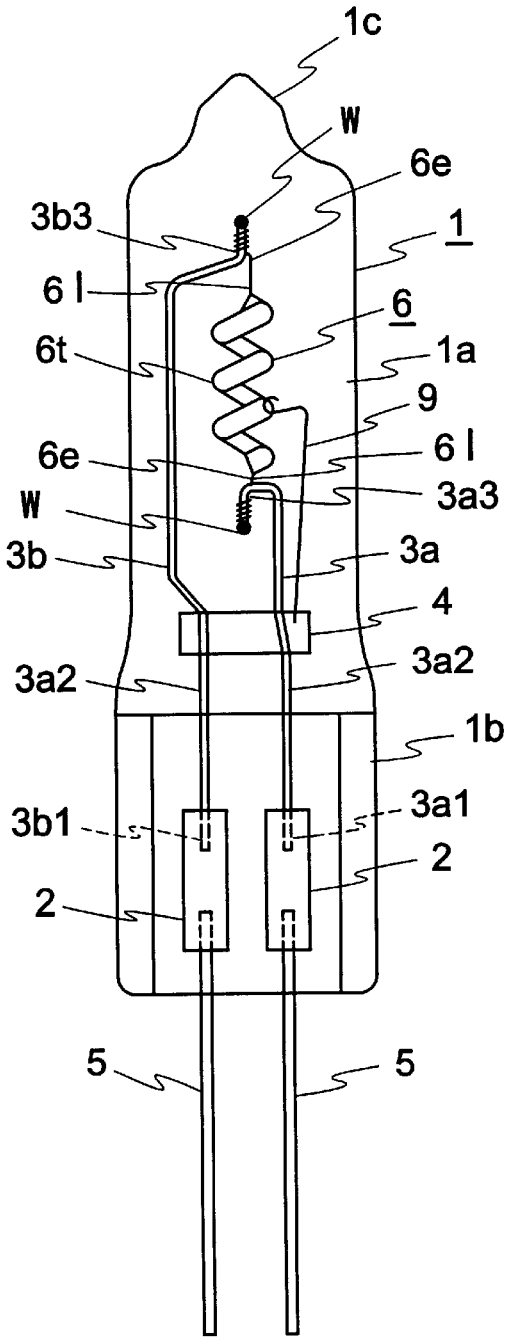
FIG. 6 is a side view of a halogen incandescent lamp according to a second embodiment.

Another aspect of the invention will be described below in detail. FIG. 6 shows a side view of a halogen incandescent lamp according to a second embodiment. The same reference characters designate identical or corresponding features compared to the lamp in the first embodiment as shown in FIGS. 1 to 5. Therefore, detailed explanations of such similar structure will not be provided. The shape and operation of this embodiment is substantially the same in the first embodiment, except for the method of forming the legs. In this embodiment, each of legs 6*l* is formed by a single strand of the tungsten filament wire 6*e* of the triple-coiled filament. When the legs 6*l* are formed by the filament wire 6*e* itself, the legs do not heat or illuminate. Accordingly, the filament 6 can generate the greater total luminous flux. The legs 6*l* formed by the filament wire 6*e* may extend from the first coiling 6*p*, and the first coiling 6*p*may extend from the third coiling 6*t* or the second coiling 6*s*. It is suitable for the filament wire 6*e* to extend directly from the third coiling 6*t*. In order to connect the filament wire 6*e* to inner conductive wires 3*a*, 3*b*, leg winding portions 3*a*3, 3*b*3 may be welded or pinched, after the leg 6*l* of the filament wire 6*e* is wound around the conductive wire 3*a*, 3*b*. After the leg winding portion 3*a*3, 3*b*3 is covered by a metal sleeve (not shown), the metal sleeve may be pinched.

Figure 7:
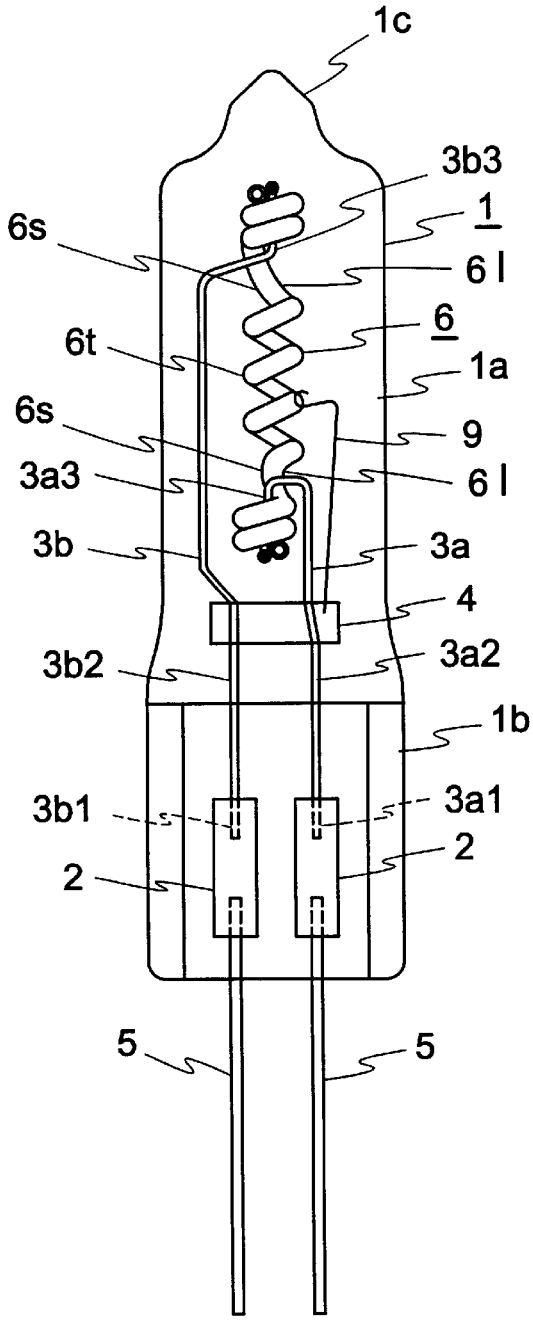
FIG. 7 is a side view of a halogen incandescent lamp according to a third embodiment.

FIG. 7 shows a side view of a halogen incandescent lamp according to a third embodiment. The similar reference characters designate elements identical or corresponding to the elements of the lamp in the first embodiment shown in FIGS. 1 to 5. Therefore, a detail explanation of such a structure will not be provided. The shape and operation of this embodiment is substantially the same in the first embodiment. In this embodiment, legs 6*l* are formed by the second coiling 6*s* of the triple-coiled filament 6. Accordingly, the legs 6*l* slightly heat or light up. However, when the second coiling 6*s* from the legs, the filament 6 does not vibrate as easily.

FIG. 8 shows a side view of a halogen incandescent lamp according to a fourth embodiment. The same reference characters designate elements identical or corresponding to the elements of the lamp in the first embodiment shown in FIGS. 1 to 5. Therefore, a detail explanation of such a structure will not be provided. The operation of this embodiment is substantially the same in the first embodiment. In this embodiment, a light-transmitting envelope 1' is formed in an ellipsoid shape la having an interference filter 10 instead of the cylindrical portion 1*a* in the first embodiment.

Figure 9:
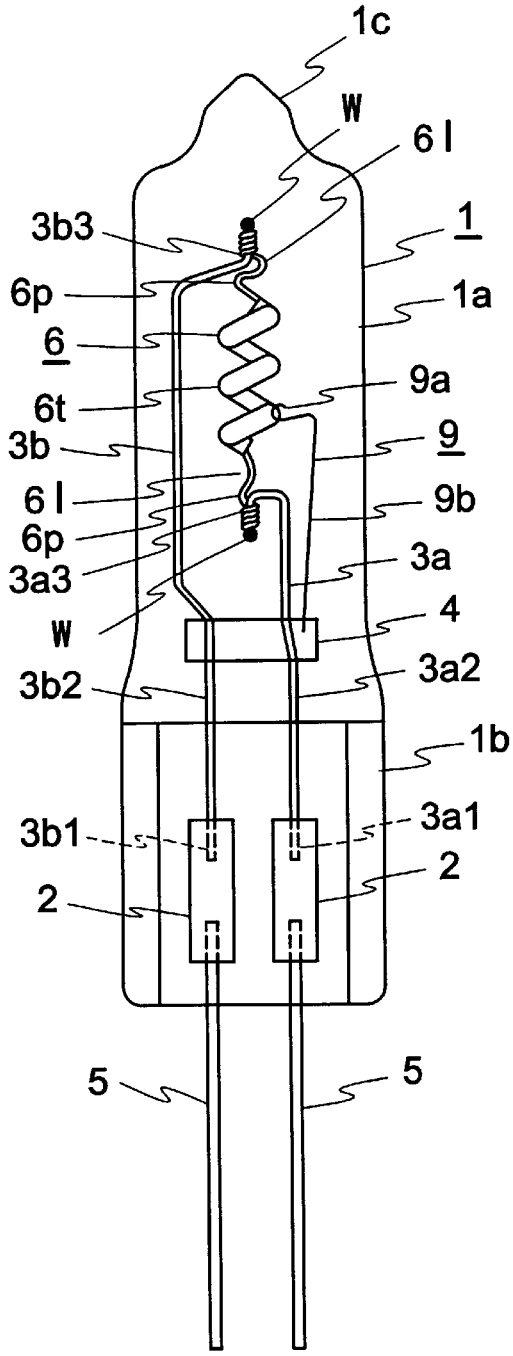
FIG. 9 is a side view of a halogen incandescent lamp according to a fifth embodiment.

FIG. 9 shows a side view of a halogen incandescent lamp according to a fifth embodiment. The same reference characters designate identical or corresponding elements to the elements of the lamp in the first embodiment shown in FIGS. 1 to 5. Therefore, a detail explanation of such a structure will not be provided. The shape and operation of this embodiment is substantially the same as the first embodiment. In this case, the third coiling 6*t* of the triple-coiled filament is formed with three turns. Each of legs 6*l*, 6*l* is formed by the first coiling 6*p*. The ring-shape portion 9*a* of the support member 9 supports a middle turn of the third coiling 6*t*, and the other end 9*b* of the support member 9 is fixed by a glass bead 4.

Figure 10:
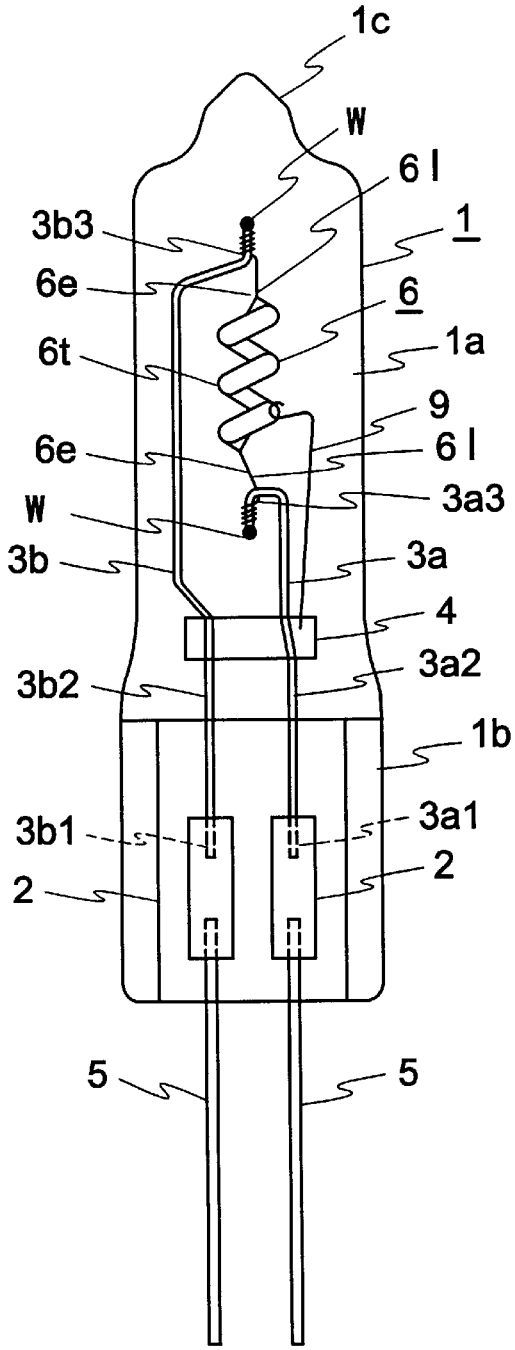
FIG. 10 is a side view of a halogen incandescent lamp according to a sixth embodiment.

FIG. 10 shows a side view of a halogen incandescent lamp according to a sixth embodiment. The same reference characters designate identical or corresponding elements to the elements of the lamp in the fifth embodiment shown in FIG. 9. Therefore, a detail explanation of such a structure will not be provided. The shape and operation of this embodiment is substantially the same as the fifth embodiment. In this embodiment, each of legs 6*l*, 6*l* is formed by a filament wire 6*e*.

Figure 11:
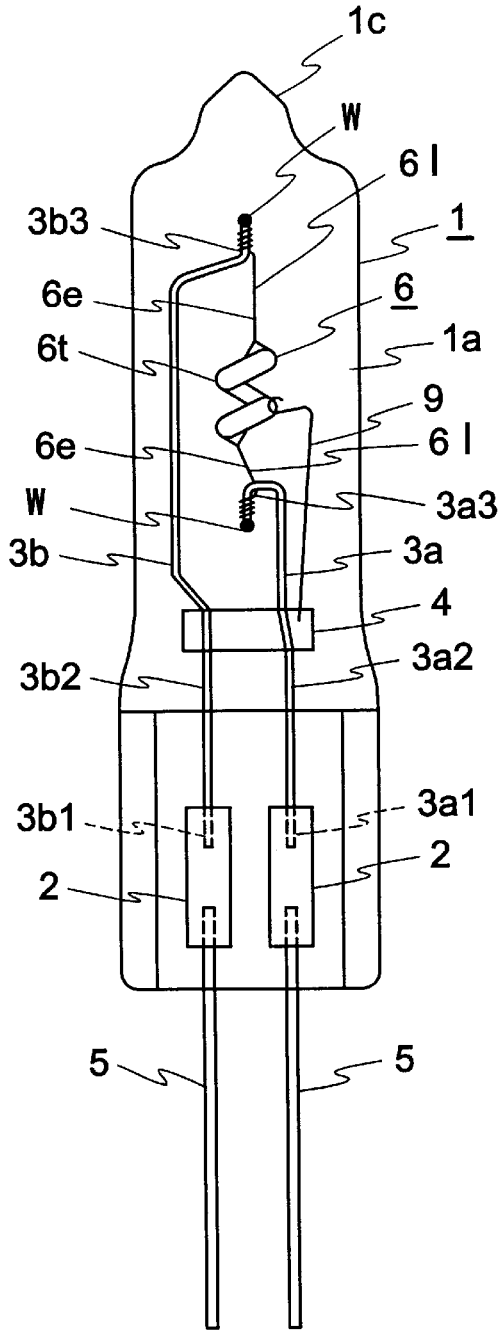
FIG. 11 is a side view of a halogen incandescent lamp according to a seventh embodiment.

FIG. 11 shows a side view of a halogen incandescent lamp according to a seventh embodiment. The same reference characters designate identical or corresponding elements to the elements of the lamp in the second embodiment shown in FIG. 6. Therefore, a detail explanation of such a structure will not be provided. The shape and operation of this embodiment is substantially the same as the second embodiment. In this embodiment, the third coiling 6*t* of the triple-coiled filament has two turns. The triple-coiled filament 6, to which a tension is applied, is arranged between inner conductive wires 3*a*, 3*b*. It is easy to recognize that the filament 6 is tensioned by cutting it from the inner conductive wires 3*a*, 3*b*. If the filament is tensioned, the filament length after being cut is shorter than that before being cut. When the third coiling has under 2.5 turns and the filament is tensioned, the filament vibrates less, because the two turns are respectively supported by the inner conductive wires 3*a*, 3*b*.

Detail dimensions of a triple-coiled filament of this embodiment will be described in Example 5.

EXAMPLE 5

The triple-coiled filament in this Example 5 is applied to a lamp having a rated voltage of 110V, and a rated lamp wattage of 40 W.

| | First coiling | Second coiling | Third coiling |
|---|---|---|---|
| Diameter (mm) | 0.042 | 0.283 | 0.966 |
| Diameter of mandrel (mm) | 0.2 | 0.4 | 1.5 |
| % mandrel | 476 | 141 | 155 |
| % pitch | 221 | 191 | 172 |
| Original design length of filament (mm) | | | 3.2 |
| Original design outer diameter (mm) | | | 3.43 |
| Turns of third coiling | | | 2 |

According to the invention, a third coiling of the filament may have about one and half (1.5) turns to about four (4) turns. When the coil turns are less than 1.5, the outer diameter of the filament becomes large. Accordingly, most of the filament is out of the focus of the reflector, so that visible light generated by the filament can not be reflected accurately. Therefore, the light output ratio from a light fixture tends to decrease. When the coil turns are more than 4, even if the filament is tensioned or has the support member, the mass of the central portion of the filament becomes large, so that vibrations can not easily be controlled.

Figure 12:
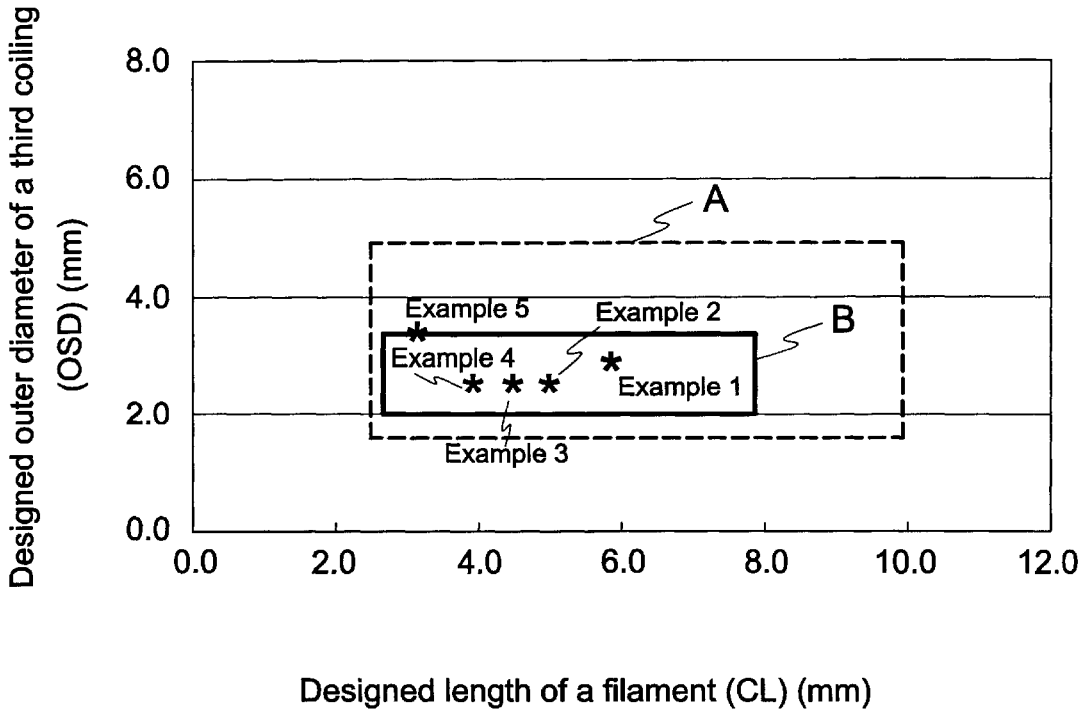
FIG. 12 is a graph showing a relationship between a designed length of a triple-coiled filament and a designed outer diameter of a third coiling.

FIG. 12 shows a graph of an original design length of the triple-coiled filament relative to an original design outer diameter of the third coiling. The horizontal axis indicates an original design length of the filament CL (mm). The vertical axis indicates an original design outer diameter of the filament OSD (mm). The original design length and diameter of the filament according to Examples 1 to 5 are indicated. The original design length and diameter of the filament of the invention may be a region A surrounded by a dotted line. Furthermore, a region B, surrounded by a solid line, shows a more preferable range. The length of the filament is longer than the original design length of the filament, because the filament is actually tensioned or extended between the conductive wires.

Figure 13:
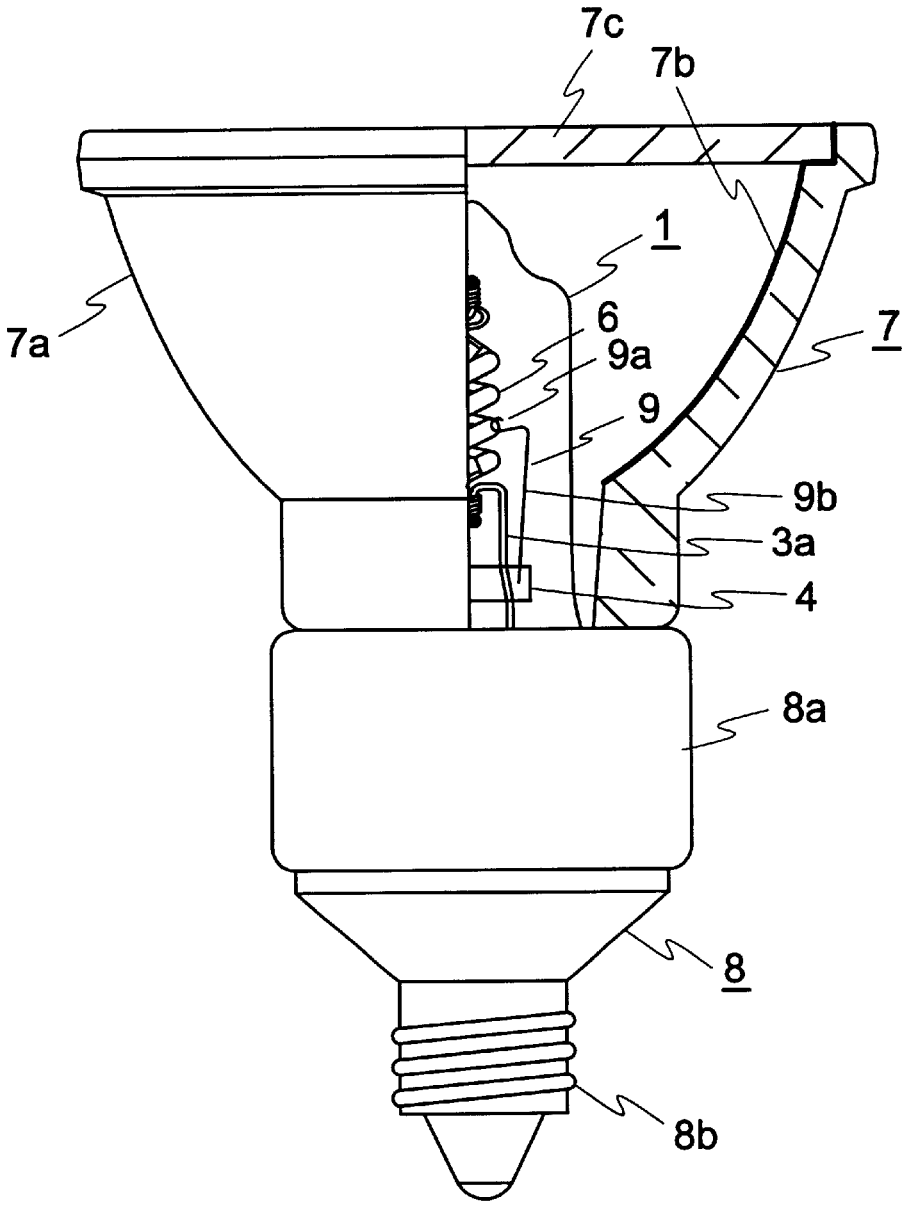
FIG. 13 is a side view, partly in section of a halogen incandescent lamp having a reflector according to the present invention.

FIG. 13 shows a side view, partly in section, of a halogen incandescent lamp having a reflector. It includes a halogen incandescent lamp 1, a reflector 7 accommodating the halogen incandescent lamp 1, and a base 8 made of a ceramics. A body 8*a* having a lamp cap 8*b* is fixed to a neck portion of the reflector 7 with inorganic adhesives.

The reflector 7, made of a glass, comprises a reflecting portion 7*a* having a focus, a reflection filter 7*b* coated on the inner surface thereof, and a translucent face plate 7*c* covering a front opening portion thereof. An outer diameter of the triple-coiled filament 6 may be in a range of $1/30$ to $1/10$ in comparison with a diameter of the front opening portion of the reflector 7. When the outer diameter of the filament 6 is less than $1/30$, the filament 6 becomes too small, so that it is difficult for the filament to be located at the focus of the reflector. When the outer diameter of the filament is over $1/10$, the filament becomes too large. Therefore, the reflector can not accurately reflect visible light, so that the reflective efficiency decreases. The outer diameter of the triple-coiled filament 6 may be in a range of $1/25$ to $1/14$ in comparison with the diameter of the front opening portion of the reflector 7. A length of the triple-coiled filament may be in a range of $1/20$ to $1/5$ in comparison with a diameter of the front opening portion of the reflector 7. The length of the triple-coiled filament may alternatively be in a range of $1/17$ to $1/6$ in comparison with the diameter of the front opening.

The reflection filter may be made of the same material as the above-mentioned interference filter. In this case, the filter operates so as to reflect visible light from the lamp and to transmit infrared radiation. The lamp 1 is fixed to the reflector with inorganic adhesives. The center of triple-coiled filament 6 of the lamp 1 is disposed at the focus of the refractor 7. Also, since the triple-coiled filament 6 is shorter than a coiled-coil filament, it is easy to dispose around the focus of the reflector 7. Therefore, visible light generated by the triple-coiled filament 6 is appropriately reflected by the reflecting portion 7*a*.

Figure 14:
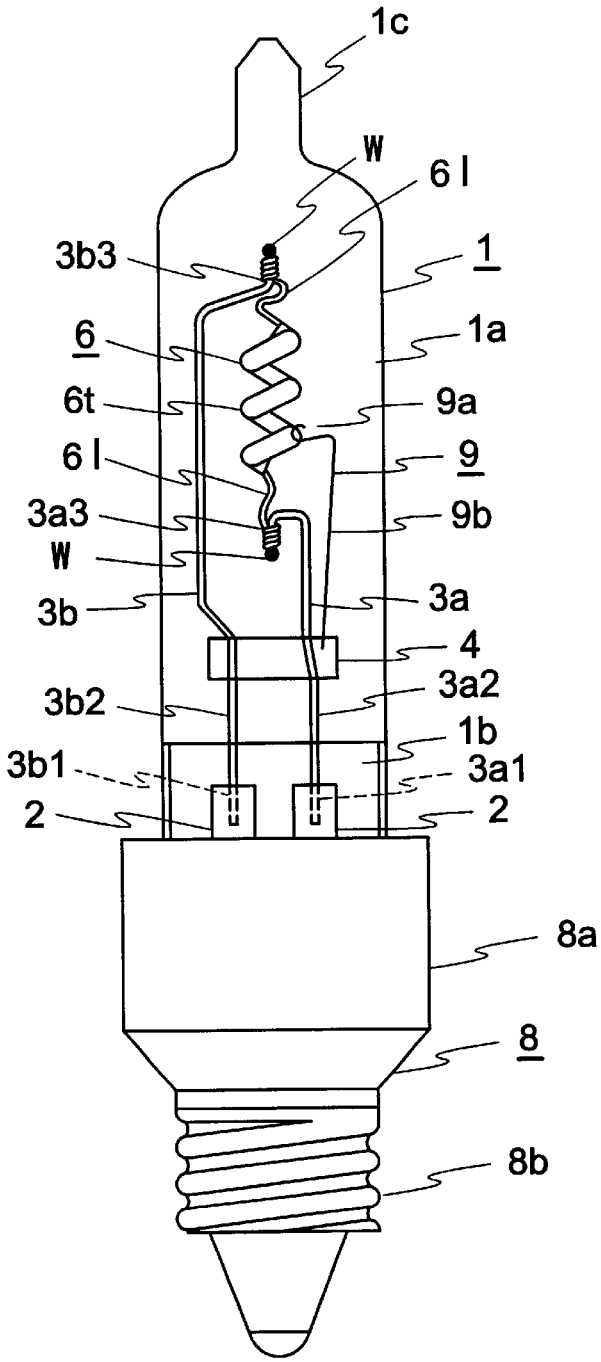
FIG. 14 is a side view of a halogen incandescent lamp according to an eighth embodiment of the present invention.

FIG. 14 shows a side view of a halogen incandescent lamp. The same reference characters designate identical or corresponding elements to the elements of the lamp shown in FIG. 9. Therefore, a detail explanation of such a structure will not be provided. The shape and operation of this embodiment is substantially the same in FIG. 9. In this case, the lamp further comprises a base 8 having a body 8*a* made of ceramics, and a lamp cap 8*b* of E11 type.

FIG. 15 shows a side view of a halogen incandescent lamp. The same reference characters designate identical or corresponding elements to the elements of the lamp in the second embodiment shown in FIG. 6. Therefore, a detail explanation of such a structure will not be provided. In this case, a light-transmitting envelope 1" comprises two seal portions 1*b*, 1*b* having bases 8 of the Rs7 type. A pair of inner conductive wires 3*a*, 3*b* may be located on the center axis of the envelope 1". A filament is arranged between the inner conductive wires 3*a*, 3*b*. A support member 9 supports the triple-coiled filament.

Figure 16:
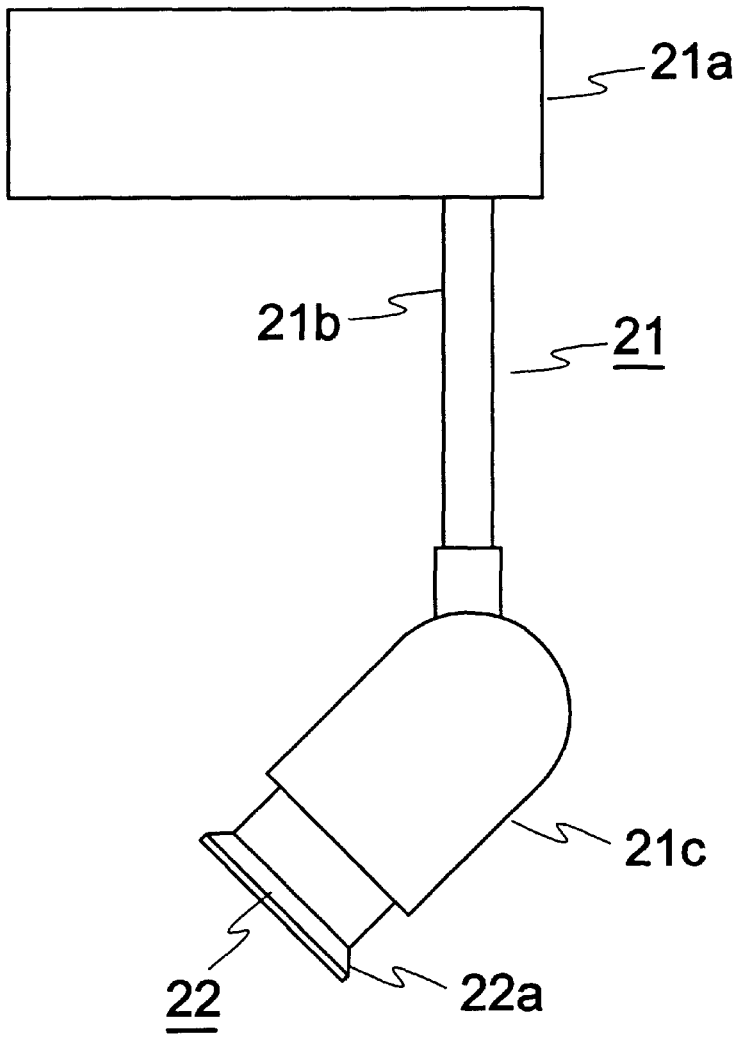
FIG. 16 is a side view of a lighting apparatus using the lamp according to the present invention.

FIG. 16 shows a side view of a lighting apparatus using the above-mentioned lamp. A spotlight is provided with a halogen incandescent lamp 22 having a reflector 22*a* and a housing 21 accommodating the lamp 22. The housing 21 comprises a base 21*a* adapted to be fixed to a ceiling, for example, a holding member 21*b* held by the base 21*a*, and a lamp holding member 21*c*. The holding member 21*b* has cables therein to electrically connect the lamp 22 to a circuit contained in the base 21*a*. According to this embodiment, it is easy to position the triple-coiled filament around a focus of the reflector. Therefore, visible light generated by the filament is accurately reflected by the reflector, so that the visible light can accurately irradiate a predetermined area. As a result, the light output ratio of the lighting apparatus can be improved.

What is claimed is:

1. A halogen incandescent lamp, comprising:

a light-transmitting envelope, filled with gas including halogen gas and inert gas;

a pair of inner conductive wires arranged in the envelope;

a triple-coiled filament, which has a first coiling, a second coiling, and a third coiling, is re-crystallized, is connected between ends of the inner conductive wire, and meets the following condition: % p1≧% p2≧% p3, wherein % p1 is a pitch ratio of the first coiling defined by the following formula: % p1=(p1/D)*100, wherein D is a diameter of a filament wire;

% p2 is a pitch ratio of the second coiling defined by the following formula: % p2=(p2/D)*100, wherein D is an outer diameter of the first coiling, and % p3 is a pitch ratio of the third coiling defined by the following formula: % p3=(p3/D)*100, wherein D is an outer diameter of the second coiling, p1, p2 and p3 are respectively a distance from center to center of two adjacent coil turns of the first coiling, the second coiling, and the third coiling.

2. A halogen incandescent lamp according to claim 1, wherein the triple-coiled filament meets the following conditions: about 130≦% p1≦about 400, about 130≦% p2≦about 300, and about 130≦% p3≦about 300.

3. A halogen incandescent lamp according to claim 1, wherein the triple-coiled filament is formed by being wound around a first mandrel having a diameter of DM1, a second mandrel having a diameter of DM2, and a third mandrel having a diameter of DM3, and meets the following conditions: about 100≦%M1≦about 700, about 100≦%M2≦about 300, and about 100≦%M3≦about 700, wherein %M1 is a mandrel ratio of the first coiling defined by the following formula: %M1=(DM1/D)*100, wherein D is a diameter of the filament wire;

%M2 is a mandrel ratio of the second coiling defined by the following formula: %M2=(DM2/D)*100, wherein D is an outer diameter of the first coiling, and %M3 is a mandrel ratio of the third coiling defined by the following formula: %M3=(DM3/D)*100, wherein D is an outer diameter of the second coiling.

4. A halogen incandescent lamp according to claim 3, wherein the triple-coiled filament meets the following conditions: %M1≧%M3≧%M2.

5. A lighting apparatus, comprising:

a halogen incandescent lamp having a reflector, wherein the lamp comprises:

a light-transmitting envelope, filled with gas including halogen gas and inert gas;

a pair of inner conductive wires arranged in the envelope;

a triple-coiled filament, which has a first coiling, a second coiling, and a third coiling is re-crystallized, is connected between ends of the inner conductive wires, and meets the following condition: % p1≧% p2≧% p3, wherein % p1 is a pitch ratio of the first coiling defined by the following formula: % p1=(p1/D)*100, wherein D is a diameter of a filament wire;

% p2 is a pitch ratio of the second coiling defined by the following formula: % p2=(p2/D)*100, wherein D is an outer diameter of the first coiling, and % p3 is a pitch ratio of the third coiling defined by the following formula: % p3=(p3/D)*100, wherein D is an outer diameter of the second coiling, p1, p2, and p3 represent a distance from center to center of two adjacent coil turns of the first coiling, the second coiling, and the third coiling, respectively, and a housing accommodating the lamp.

* * * * *